US006794825B1

(12) United States Patent
Kao

(10) Patent No.: US 6,794,825 B1
(45) Date of Patent: Sep. 21, 2004

(54) DECORATIVE TREE WITH ELECTRONIC LIGHT CONTROLLER

(75) Inventor: Cheung Chong Kao, Chai Wan (HK)

(73) Assignee: Boto (Licenses) Limited, Douglas (GB)

( * ) Notice: Subject to any disclaimer, the term of this patent is extended or adjusted under 35 U.S.C. 154(b) by 0 days.

(21) Appl. No.: 10/294,088

(22) Filed: Nov. 14, 2002

(51) Int. Cl.[7] ..... H05B 37/00
(52) U.S. Cl. ..... 315/185 R; 315/185 S
(58) Field of Search ..... 315/185 R, 185 S, 315/179, 178, 129, 130, 193, 32.3, 200 A; H05B 37/00

(56) References Cited

U.S. PATENT DOCUMENTS 4,713,586 A * 12/1987 Chiang ..... 315/200 A
4,870,547 A * 9/1989 Crucefix ..... 362/123
5,629,587 A * 5/1997 Gray et al. ..... 315/292
6,091,204 A * 7/2000 Chen ..... 315/185 R
6,107,746 A * 8/2000 Chen ..... 315/185 R
2002/0135315 A1 * 9/2002 Puleo et al. ..... 315/185 R

* cited by examiner

*Primary Examiner*—Hoanganh Le
*Assistant Examiner*—Trinh Vo Dinh
(74) *Attorney, Agent, or Firm*—Camille L. Urban; G. Brian Pingel

(57) ABSTRACT

The present invention provides a decorative tree with an electronic light controller, which tree includes at least two separate and independent sets of light elements and a control unit that is adapted to receive electrical power from a power source and supply such power to each of the light element sets in a desired selectable sequence to provide a variety of different types of light displays for the tree.

11 Claims, 3 Drawing Sheets

DECORATIVE TREE WITH ELECTRONIC LIGHT CONTROLLER

FIELD OF THE INVENTION

The present invention relates in general to a decorative tree pre-assembled with lights which are illuminated in a variety of patterns as governed by an electronic controller.

DESCRIPTION OF THE PRIOR ART

It is known in the art to provide decorative trees with lights pre-assembled. Some trees bear flashing lights, others bear lights that fade in and out, while others have lights that 'chase' through the tree.

The present invention differs from the above referenced inventions and others similar in that these prior devices do not allow for selection of light displays from a variety of such displays available.

One objective of the present invention includes providing a decorative tree wherein electrical light elements are provided and a desired light display can be selected from a variety and can be easily changed to another.

SUMMARY

The present invention provides a decorative tree wherein a plurality of electrical light elements arranged in separate and independent sets are associated with the branches and with a display control means. The display control means is used to provide power to each of the sets of light elements in one of a plurality of sequences each of which provides a different light display. The different sequences may include simply turning all sets of lights on, flashing different sets of lights at different times, flashing all sets of lights together, chasing lights throughout the tree, fading all sets of lights on and off, fading some sets of lights on while others are fading off, and other such patterns. The display control means includes means for securing it to the decorative tree, a display control integrated circuit chip that forms a light display control circuit adapted to supply power to each set of lights of the tree in a selectable sequence and a switch means for controlling the sequence desired.

The decorative tree comprises a top, a middle and a bottom portion each formed with a portion of a trunk and a plurality of branches. In the preferred embodiment, a first set of lights is associated with the bottom portion of the tree, a second set with the middle portion of the tree, and a third set with the top portion of the tree. Each of the first, second, and third set of lights is electronically connected with the control circuit of the control means. Upon actuation of the switch means for selecting a desired light sequence, the light display control circuit provides power to the set of lights associated with that sequence and the desired light display is therefore effected over the entire tree.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
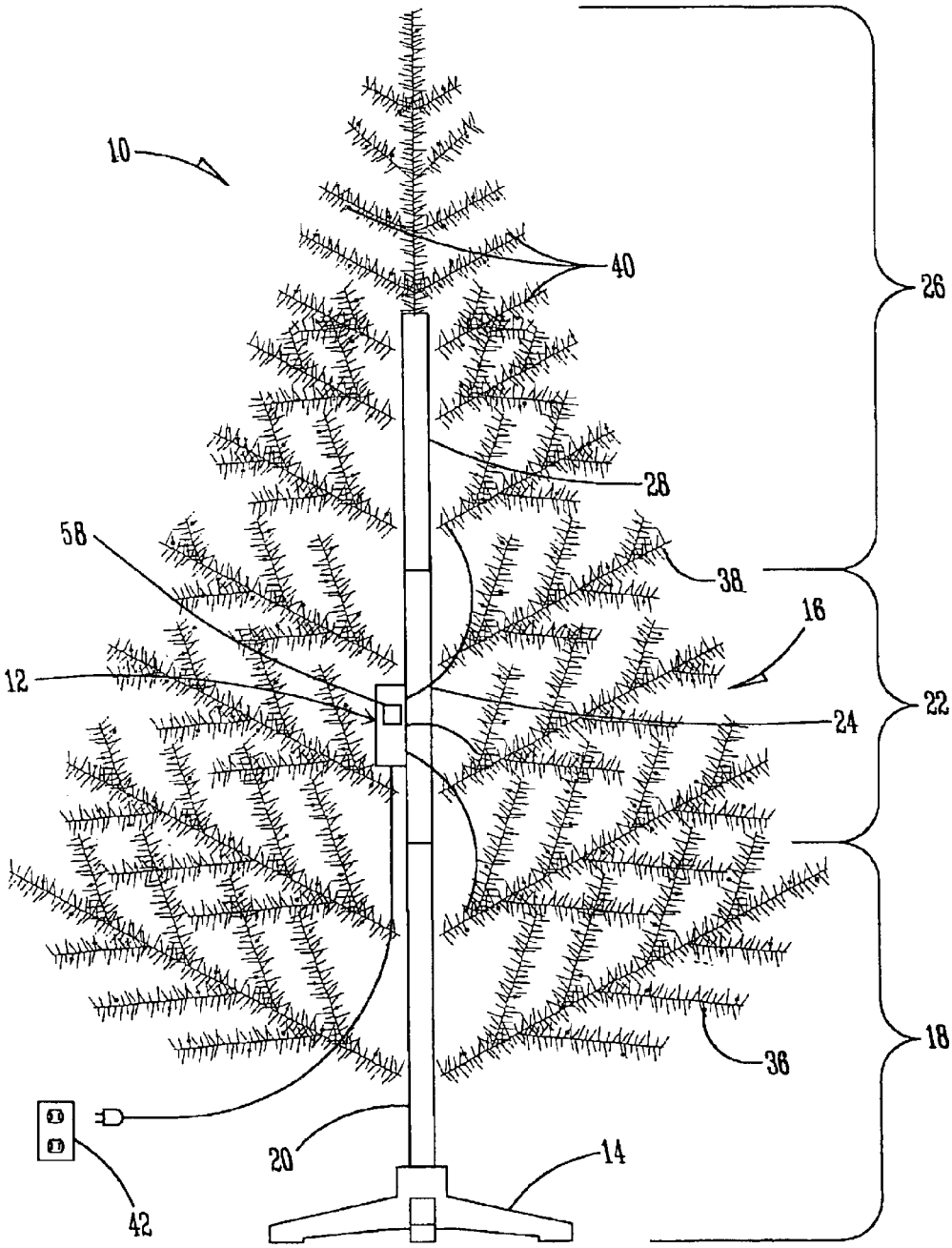
FIG. 1 is preferred embodiment of the decorative tree of the present invention.
Figure 2:
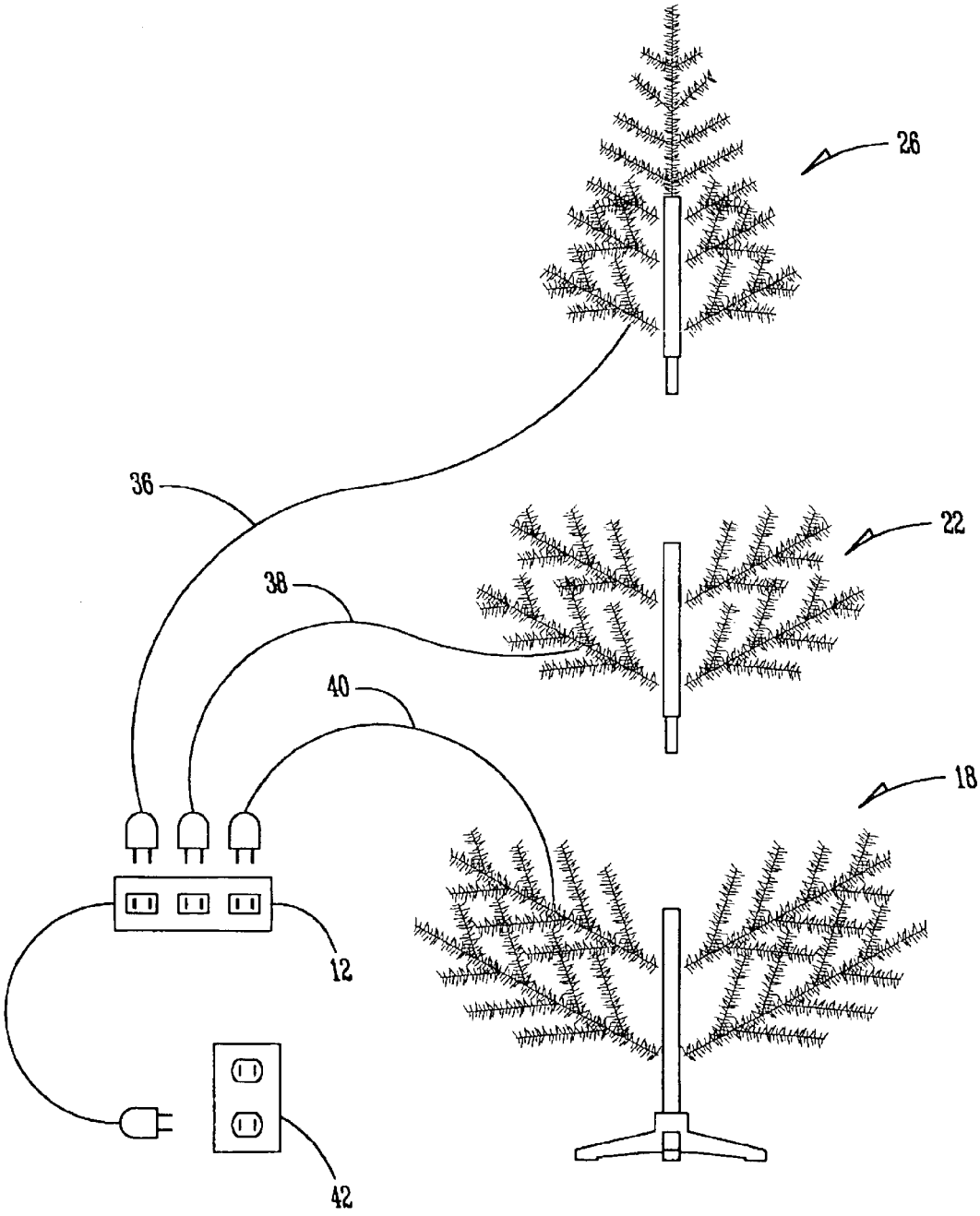
FIG. 2 is an exploded view of the decorative tree FIG. 1 components of the display control means including a plurality of display circuits.

FIG. 1 shows a decorative tree 10 having multiple independent sets of light elements and a display control unit 12 of the present invention that controls the supply of electrical power to the light elements. Said tree 10 is supported in a vertical position by a tree stand 14. The tree 10, as best indicated in FIG. 2, includes a body 16 that has a bottom portion 18 with a first trunk segment 20, a middle portion 22 with a second trunk segment 24 and a top portion 26 that has a third trunk section 28. As is well known in the art the tree portions 18, 22 and 26 are designed to be readily assembled together with a bottom end of one being receivable in a top end of the portion under it.

Each of the body portions 18, 22 and 26 is associated respectively with a set of electrical light elements 36, 38 and 40 which are supplied power via the control unit 12 from an electrical source outlet 42. The light elements 36, 38 and 40 are associated with the control unit 12 in such fashion that each of the sets 36, 38, and 40 can be lit independently of the other two sets so that a variety of lighting patterns can be made with the sets 36, 38 and 40.

The display control unit 12 of the preferred embodiment is removably attached to the second trunk segment 24 with a strap 44 and is also detachably associated with the power source outlet 42. The display control unit 12 preferably is small enough that when attached to the first trunk segment 18 it is substantially hidden from view.

Figure 3:
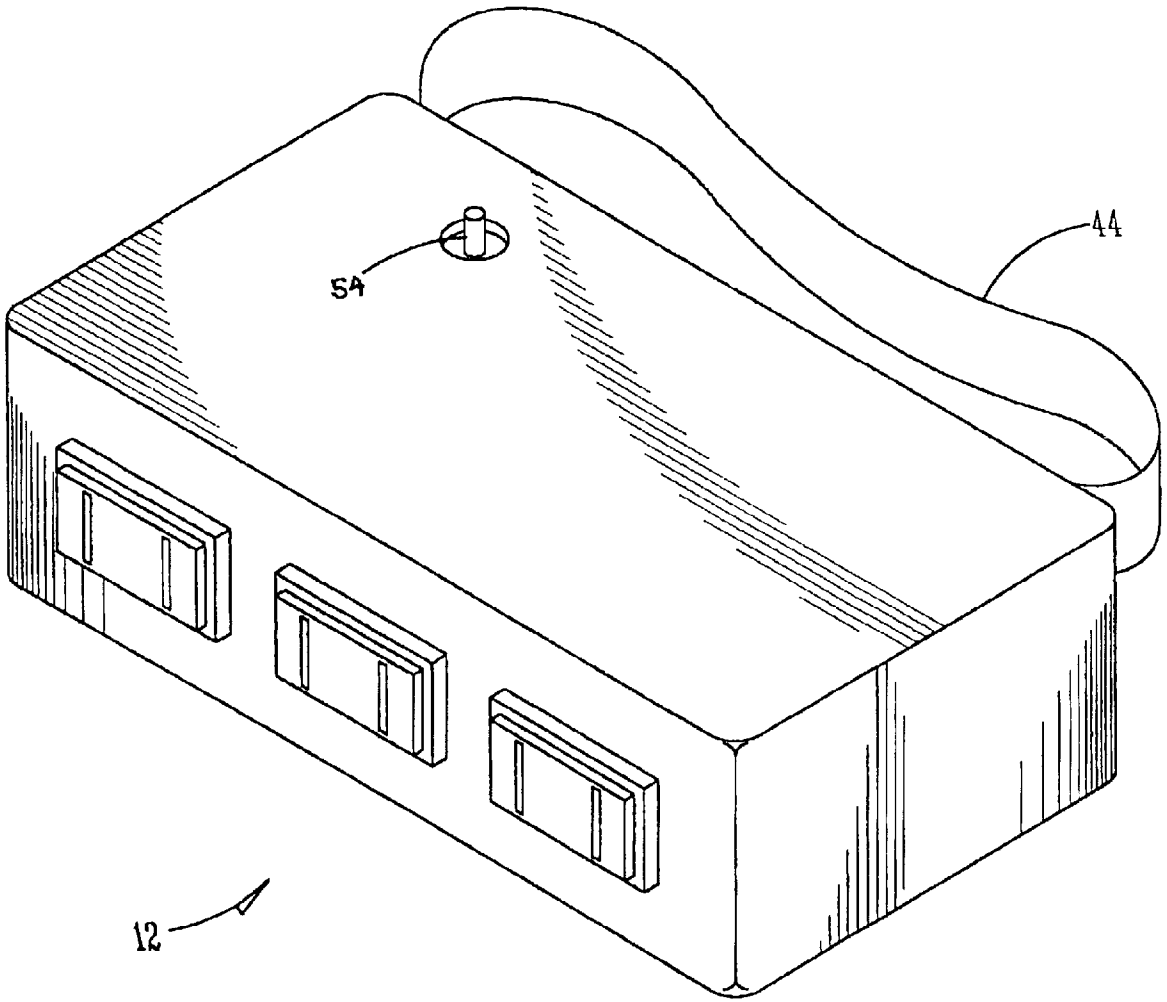
FIG. 3 is an enlarged and exploded view of the display control means and power cords of a plurality of light sets.

In the preferred embodiment it has been found that integrated circuit chip No. M 800 565 manufactured by Mosdesign Semiconductor Corp. satisfactorily serves as the control circuitry for the unit 12. As shown in FIG. 3, which is an enlarged view of the display control unit 12, the unit 12 has outlets 48 for semi-permanently inserting a male plug of each of the sets of light elements 36, 38, and 40 to electrically attach such light elements to the display control unit 12. The unit 12 is plugged into a source of electrical power such as a wall outlet 42 as shown in FIG. 3. A switch means 54 for selecting the desired sequence of power to be provided to the sets of light elements 36, 38, and 40 are also provided in the control unit 12. The switch means 54 is used to choose the particular type of display of light elements which is governed by the integrated circuit chip 58 of the unit 12.

The display control unit 12 of the preferred embodiment is adapted to provide at least eight different types of light displays for the decorative tree involving the light elements 36, 38 and 40. However, the invention can be modified to have a different number of set of light elements. In one contemplated modification of the preferred embodiment, more than three light sets are used and additional means for semi-permanently attaching each set to said control unit 12 are provided. This modification may include additional control circuits for the unit 12. The light sets are arranged in the decorative tree such that all of the light elements of an individual set are in a generally common portion of the tree. Thus, the present invention has been described in an illustrative manner. It is to be understood that the terminology that has been used is intended to be in the nature of words of description rather than of limitation.

Many modifications and variations of the present invention are possible in light of the above teachings. For example, light elements may be of different or multiple colors. Or, light sets may be arranged vertically or horizontally on the tree providing different effects. Therefore, within the scope of the appended claims, the present invention may be practiced otherwise than as specifically described.

What is claimed is:

1. A display control means for a plurality of electrical light elements on a decorative tree comprising:

(a) said decorative tree is formed of top, middle and bottom portions;

(b) said electrical light elements are arranged in at least three separate and independent sets, one set of light elements for each of said tree portions;

(c) said control means has electronic circuit means adapted to receive electrical power from a power source and to supply such power to said light element sets in a desired selectable sequence to provide a variety of light displays for said tree; and (d) said control means includes a switch means for choosing said desired sequence.

2. The display control means as recited in claim 1, wherein said electronic circuit means provide at least four different light displays.

3. The display control means as recited in claim 1, wherein said control means is small enough to be attachable to the trunk of said tree and is substantially hidden from view by the foliage of said tree.

4. The display control means as recited in claim 1, wherein said electronic circuit means is adapted to provide at least eight different selectable power sequences to said light element sets.

5. The display control means as recited in claim 1, wherein said electronic circuit means is in the form of an integrated circuit chip.

6. A decorative artificial tree assembly comprising:

(a) a tree stand;

(b) a bottom tree portion having a first trunk segment that is semi-permanently attached to said stand and is supported thereby;

(c) an upper tree portion having a second trunk segment attachable to said first trunk segment in a semi-permanent relationship;

(d) a first set of light elements associated with said bottom tree portion;

(e) a second set of light elements associated with said upper tree portion;

(f) a display control means for receiving electrical power from a power source and including;

(1) means for providing electrical power to said light element sets in a desired selectable sequence to provide a variety of light displays for said tree; and (2) selection means for choosing said desired sequence.

7. The decorative artificial tree assembly as recited in claim 6, wherein said display control circuits provide at least four different light displays.

8. The decorative artificial tree assembly as recited in claim 7, wherein said control means is small enough to be attachable to one of the trunk segments of said tree and is substantially hidden from view by the foliage of said tree.

9. The decorative artificial tree assembly as recited in claim 8, wherein said display control circuits are adapted to provide at least eight different selectable lighting sequences to said element sets.

10. The decorative artificial tree assembly as recited in claim 6, wherein said decorative tree further includes a middle portion and said light elements are arranged in at least three separate and independent sets, one set of light elements for each of said tree portion.

11. The decorative artificial tree assembly as recited in claim 6, wherein said means of providing electrical power is in the form of an integrated circuit chip.

* * * * *